US010939192B2

(12) United States Patent
Michel et al.

(10) Patent No.: US 10,939,192 B2
(45) Date of Patent: Mar. 2, 2021

(54) ELECTRET CONDENSER MICROPHONE AND MANUFACTURING METHOD THEREOF

(71) Applicants: Alan Michel, Shanghai (CN); Sean Gao, Shanghai (CN); Guangyue Lv, Shanghai (CN)

(72) Inventors: Alan Michel, Shanghai (CN); Sean Gao, Shanghai (CN); Guangyue Lv, Shanghai (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/326,338

(22) PCT Filed: Aug. 18, 2016

(86) PCT No.: PCT/CN2016/095879
§ 371 (c)(1),
(2) Date: Feb. 18, 2019

(87) PCT Pub. No.: WO2018/032466
PCT Pub. Date: Feb. 22, 2018

(65) Prior Publication Data

US 2019/0215591 A1 Jul. 11, 2019

(51) Int. Cl.
*H04R 19/01* (2006.01)
*H04R 31/00* (2006.01)
(Continued)

(52) U.S. Cl.
CPC ..... *H04R 1/04* (2013.01); *H04R 7/22* (2013.01); *H04R 19/016* (2013.01); *H04R 31/006* (2013.01)

(58) Field of Classification Search
CPC ..... H04R 1/04; H04R 31/006; H04R 19/016; H04R 7/22
See application file for complete search history.

(56) References Cited

U.S. PATENT DOCUMENTS 5,097,515 A * 3/1992 Baba ..... H04R 19/016 381/111
6,323,049 B1 * 11/2001 Lee ..... H04R 19/016 438/106
(Continued)

FOREIGN PATENT DOCUMENTS

CN 1578538 A 2/2005
CN 101835077 A 9/2010
(Continued)

OTHER PUBLICATIONS

International Search Report dated Jun. 1, 2017, PCT/CN2016/095879 filed Aug. 18, 2016, 12 pgs.
(Continued)

*Primary Examiner* — Oyesola C Ojo
(74) *Attorney, Agent, or Firm* — Brooks Kushman P.C.

(57) ABSTRACT

An electret condenser microphone is provided. The electret condenser microphone comprises a diaphragm, a backplate with a metal layer on the side facing the diaphragm and an amplifier on the other side, the input of the amplifier electrically connecting the metal layer, a spacer separating the diaphragm and the backplate PWB; and a metal sleeve accommodating the diaphragm, the backplate and the spacer.

21 Claims, 5 Drawing Sheets

(51) Int. Cl.
*H04R 1/04* (2006.01)
*H04R 7/22* (2006.01)

(56) References Cited

U.S. PATENT DOCUMENTS 7,130,434 B1 * 10/2006 Grattan ..... H04R 1/12 381/113
7,221,768 B2 * 5/2007 Sjursen ..... H04R 19/016 381/322
7,233,674 B2 * 6/2007 Song ..... H04R 19/016 381/113
7,239,714 B2 * 7/2007 de Blok ..... H04R 19/016 381/174
7,620,191 B2 * 11/2009 Tanabe ..... H04R 19/016 381/174
8,107,652 B2 * 1/2012 Dyer ..... H04R 19/016 381/191
8,509,459 B1 * 8/2013 Isvan ..... H04R 19/016 381/113
2001/0033670 A1 10/2001 Tai et al.
2003/0099368 A1 * 5/2003 Chiang ..... H04R 19/016 381/175
2005/0025328 A1 2/2005 Song
2005/0094832 A1 * 5/2005 Song ..... H04R 1/06 381/174
2006/0245606 A1 * 11/2006 Hsieh ..... H04R 19/016 381/191
2007/0025571 A1 * 2/2007 Collins ..... H04R 1/38 381/174
2007/0121967 A1 5/2007 Sjursen et al.
2007/0160247 A1 * 7/2007 Makihata ..... H04R 19/016 381/355
2009/0257613 A1 * 10/2009 Khamashta ..... H04R 1/04 381/355
2011/0007914 A1 * 1/2011 Li ..... H04R 1/06 381/191
2011/0075863 A1 * 3/2011 Rosen ..... H04R 19/04 381/111
2012/0321111 A1 * 12/2012 Lillelund ..... H04R 1/04 381/174

FOREIGN PATENT DOCUMENTS

CN 203151732 U 8/2013
CN 103517190 A 1/2014
CN 204131725 U 1/2015
CN 105554600 A 5/2016
CN 205454092 U 8/2016
EP 1158833 A2 11/2001
KR 20020024123 A 3/2002
WO 9739464 A1 10/1997
WO 2006116739 A1 11/2006

OTHER PUBLICATIONS

European Search Report for Application No. 16913223.0, dated Feb. 19, 2020, 8 pages.
English Translation of Chinese Office Action for Application No. 201680088437.2, dated May 8, 2020, 14 pages.

* cited by examiner

ELECTRET CONDENSER MICROPHONE AND MANUFACTURING METHOD THEREOF

CROSS-REFERENCE TO RELATED APPLICATION

This application claims the benefit of priority to PCT Patent Application No. PCT/CN2016/095879, filed on Aug. 18, 2016, and entitled "ELECTRET CONDENSER MICROPHONE AND MANUFACTURING METHOD THEREOF", the entire disclosure of which is incorporated herein by reference.

TECHNICAL FIELD

This invention relates to microphones, and in particular to electret condenser microphones and a method of manufacturing the same.

BACKGROUND

An electret condenser microphone (ECM) is a type of electrostatic capacitor-based microphone. Today, electret condenser microphones are widely used in electronic devices like mobile phones, laptops, etc.

In a typical electret condenser microphone, the active capacitance forms a capacitive charge divider with the various parallel passive capacitances. In general, the sensitivity of a microphone is reduced by the ratio of the active capacitance divided by the sum of both active and passive capacitances. In typical electret condenser microphones, this may reduce the sensitivity of the microphone by anywhere from 6 to 10 dB or more, decreasing the electrical SNR.

In most standard ECM amplifiers, the high input impedance amplifier is placed on a printed wire board (PWB) away from the backplate of the ECM. This structure requires an insulation ring and a conductive ring to carry the charge from the backplate to the input of a high input impedance amplifier on the PWB. This connection arrangement produces significant stray capacitance.

It is expected to minimize the amount of stray capacitance loading the input and increase the sensitivity and therefore the signal to noise ratio (SNR) of a microphone.

SUMMARY

According to one embodiment, an electret condenser microphone is provided. The electret condenser microphone comprises a diaphragm, a backplate with a metal layer on the side facing the diaphragm and an amplifier on the other side, the input of the amplifier electrically connecting the metal layer, a spacer separating the diaphragm and the backplate; and a metal sleeve accommodating the diaphragm, the backplate and the spacer.

In some embodiments, the backplate in the electret condenser microphone is formed of common PWB material such as Kapton, epoxy impregnated fiberglass, epoxy resins, and the like.

In some embodiments, the spacer in the electret condenser microphone is formed of annular insulating material such as mylar.

In some embodiments, the amplifier is a junction field effect transistor (JFET) and the input is the JFET's gate terminal.

In some embodiments, the electret condenser microphone further comprises a connecting layer and a bottom layer, the connecting layer electrically connecting terminals of the amplifier to the pads on the bottom layer.

In some embodiments, the connecting layer in the electret condenser microphone is formed of annular PWB with conductive connectors protruding through the body of connecting layer.

In some embodiments, the bottom layer in the electret condenser microphone comprises a PWB substrate, conductive connectors embedded in the PWB substrate, traces and pads on the PWB substrate.

In some embodiments, the electret condenser microphone further comprises an anti-dust cover within the metal sleeve at the opening of the electret condenser microphone.

According to one embodiment, a method of manufacturing an electret condenser microphone is provided. The method comprises the steps of providing a diaphragm; providing a backplate with a metal layer on its surface towards the diaphragm and an amplifier on the other surface, the input of the amplifier being electrically connected to the metal layer; providing an insulating spacer; and bonding the diaphragm, the insulating spacer and the backplate together and inserting them into a metal sleeve.

According to one embodiment, a method of manufacturing an electret condenser microphone is provided. The method comprises the steps of providing a diaphragm; providing a backplate with a metal layer on its surface towards the diaphragm and an amplifier on the other surface, the input of the amplifier being electrically connected to the metal layer; providing a bottom layer with conductors extend through the substrate of the bottom layer and traces and pads on its surface; providing an insulating spacer; providing a connecting layer with conductive connectors protruding through the body of the connecting layer; and bonding the diaphragm, the backplate, the bottom layer, the spacer and the connecting layer together and inserting them into a metal sleeve.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
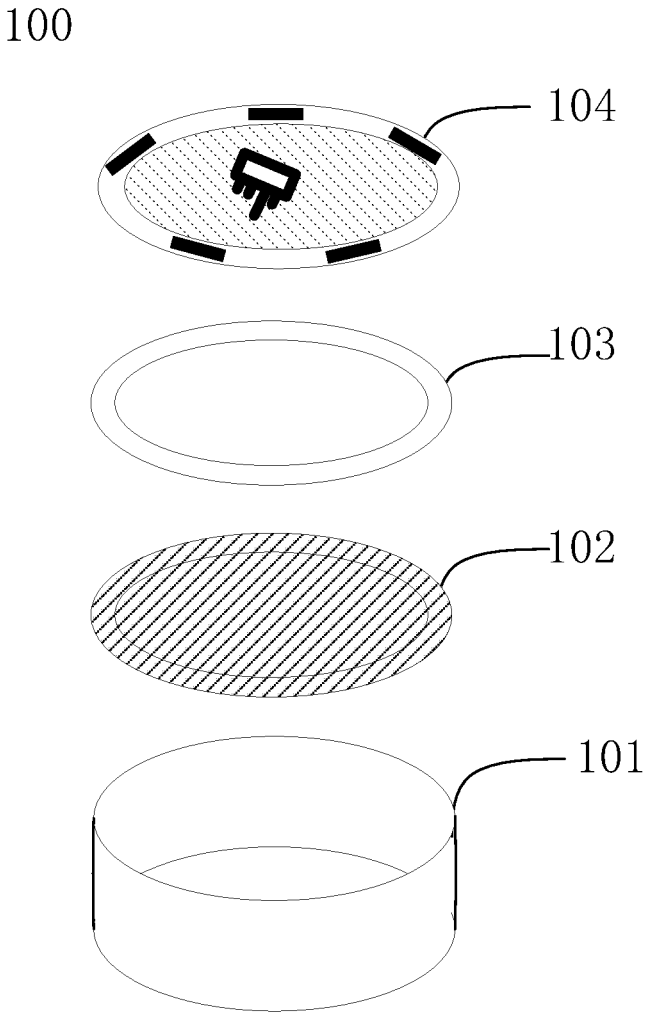
FIG. 1 is an exploded view of the microphone according to one embodiment.

The various features illustrated in the drawings may not be drawn to scale. Accordingly, the dimensions of the various features may be arbitrarily expanded or reduced for clarity. In addition, some of the drawings may not depict all of the components of a given system, method or device.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

FIG. 1 illustrates an electret condenser microphone (ECM) 100 that comprises a metal sleeve 101, a diaphragm 102, a spacer 103, and a backplate 104. Diaphragm 102 is the vibrating element of the microphone and the diaphragm 102 vibrates in response to sound waves result in a changing voltage between diaphragm 102 and backplate 104. Diaphragm 102 is made of an electrically conductive material.

Backplate 104 is made of an electrically conducting material or any material including a conductive coating. In one embodiment, backplate 104 is a PWB with an insulating substrate and electrically conducting patterns on the surface of the substrate. Diaphragm 102 and backplate 104 form a capacitor together with spacer 103 between them. There is a charged layer, i.e. the electret layer, either on diaphragm 102 or on backplate 104 to provide the capacitor with a permanent charge. Spacer 103 is made of dielectric material. In one embodiment of the invention, diaphragm 102 and backplate 104 are punched into a disk shape and accordingly, spacer 103 is an annular insulator such as mylar.

In electret condenser microphone 100, diaphragm 102, spacer 103, and backplate 104 are enclosed in metal sleeve 101.

Figure 2:
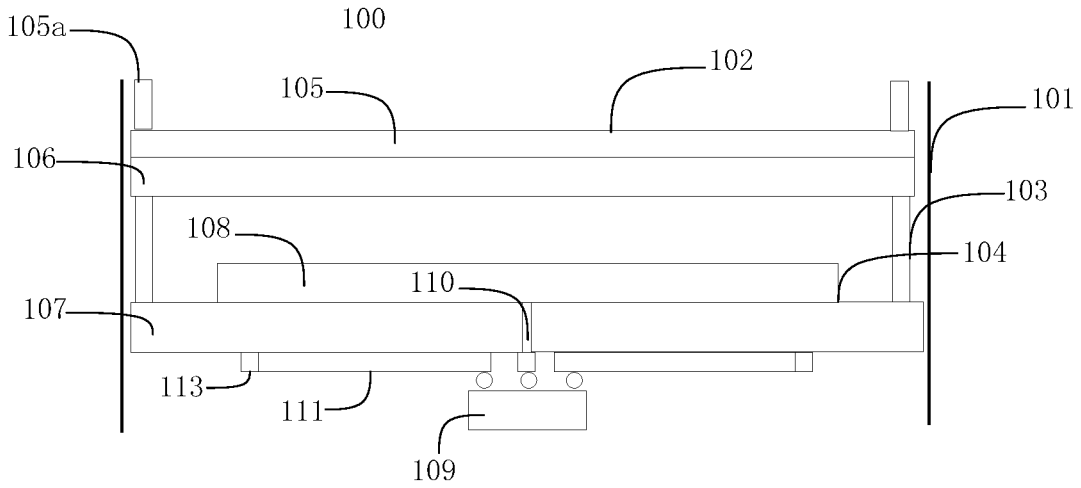
FIG. 2 is a sectional view of an example microphone of FIG. 1.

FIG. 2 is a sectional view of an example microphone according to the electret condenser microphone depicted in FIG. 1. As shown in FIG. 2, electret condenser microphone 100 includes diaphragm 102, which consists of a metallic layer 105 and an electret layer 106 attached to the surface of metallic layer 105. Metal layer 105 can be formed of sputtered metal, such as Ni, Au, Al, etc. Electret layer can be formed of PTFE (polytetrafluorethylene). A brass tension ring 105*a* is positioned on the other side of metallic layer 105.

Backplate 104 can be a PWB comprising an insulating substrate 107 and a metal layer 108 on its surface towards diaphragm 102. A circuit for processing the electrical signals to be generated by the microphone in this invention is placed on the other surface of backplate 104, which, among other components, include an amplifier. For example, the amplifier can be a junction field-effect transistor (JFET) 109. JFET 109 comprises a gate terminal, a drain terminal, and a source terminal. The gate terminal of JFET 109 is connected to metal layer 108 by a through-hole 110. Through-hole 110 has an electrical conducting interior surface extending through substrate 107 and thus it can electrically connect components on both sides of substrate 107. Copper traces 111 electrically connect source/drain terminals of JFET 109 to pads 113. Conductive pads 113 are used for grounding/connecting to other electrical components. They are the output terminals of electret condenser microphone 100. Spacer 103 is placed between diaphragm 102 and backplate 104. Diaphragm 102, spacer 103 and the backplate 104 are placed in metal sleeve 101.

When microphone 100 is working, sound enters the microphone through the opening to the diaphragm 102, causing diaphragm 102 to vibrate with the variations in sound pressure. The movement of the charged diaphragm with respect to backplate 104 creates variations in capacitance. The resulting voltage change is amplified by JFET 109. Voltage variations are coupled to the gate terminal of JFET 109 by through-hole 110. JFET 109 amplifies the output and produces an output speech signal at pads 113, to which source/drain terminal of JFET 213 are coupled. The output signal is proportional to the sound pressure on diaphragm 102.

Electret condenser microphone 100 as showing in FIG. 1 and FIG. 2 minimizes stray capacitance of a typical electret condenser microphone, which can load down active capacitance signal, and thus electret condenser microphone 100 can improve microphone sensitivity and SNR. By placing JFET 109 directly on the backplate 104 of electret condenser microphone 100, the amount of stray capacitance loading the input can be minimized.

Figure 3:
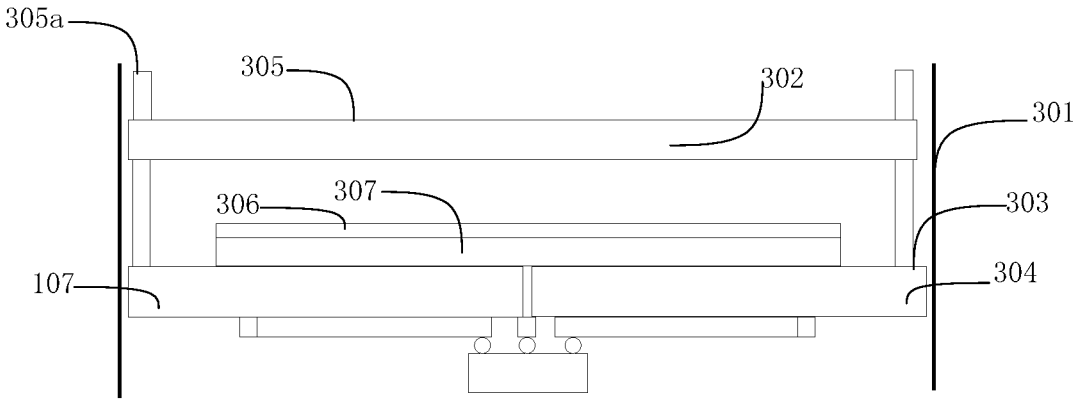
FIG. 3 is a sectional view of an alternative example microphone of FIG. 1.

FIG. 3 is a sectional view of another example microphone according to the electret condenser microphone depicted in FIG. 1. Electret condenser microphone 300 includes a diaphragm 302, a spacer 303, a backplate 304, and a metal sleeve 301 accommodating diaphragm 302, spacer 303 and backplate 304. Diaphragm 302 is only made of a metallic layer 305 and a metallic tension ring 305*a* on it, while electret layer 306 is attached to the upper surface of metal layer 308 on substrate 107 of backplate 304. Metallic layer 305 can be formed by metal such as Ni, Al, Au, etc. Under this arrangement, electret layer 306 can still provide a permanent charge so diaphragm 302 can respond to sound waves to produce a changing voltage between diaphragm 302 and backplate 304.

Figure 4:
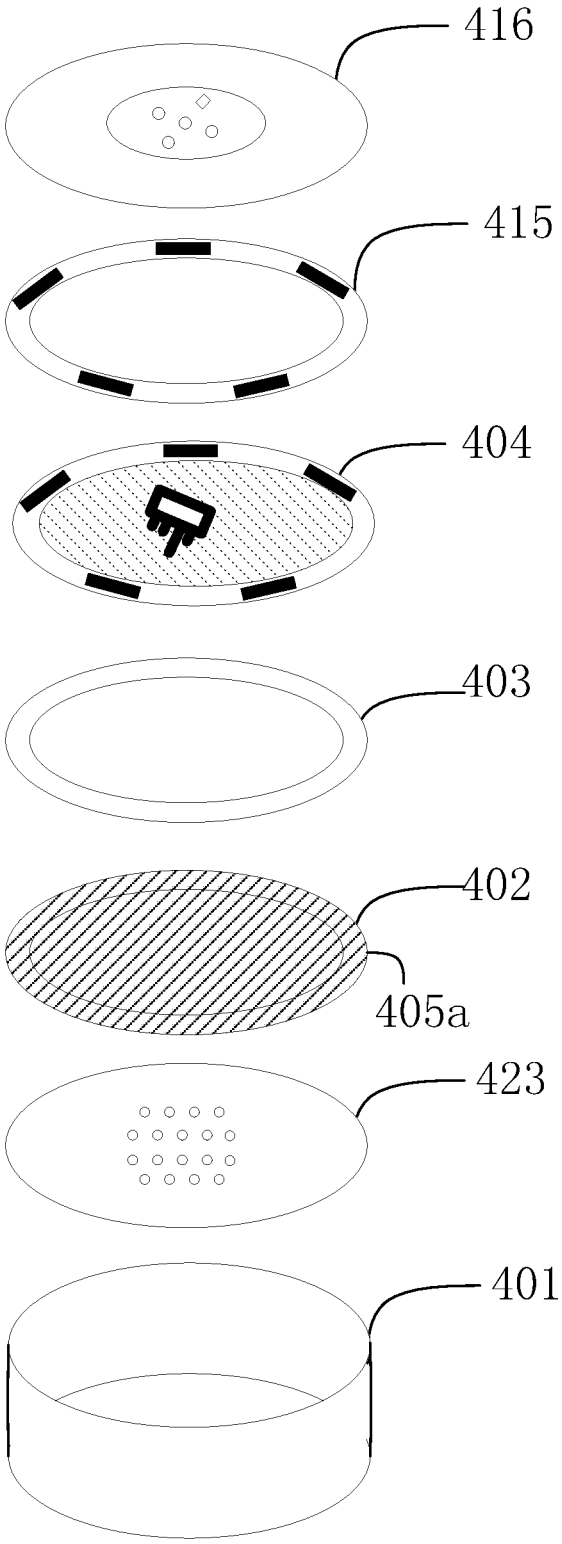
FIG. 4 is an exploded view of the microphone according to one embodiment.

In another embodiment as depicted in FIG. 4, electret condenser microphone 400 comprises a metal sleeve 401, a diaphragm 402 with a metallic tension ring 405*a* on it, a spacer 403, a backplate 404, a connecting layer 415, and a bottom layer 416. Preferably, electret condenser microphone 400 also includes an anti-dust cover 423 mounted in the opening to prevent dust from entering into the internal of the microphone.

Figure 5:
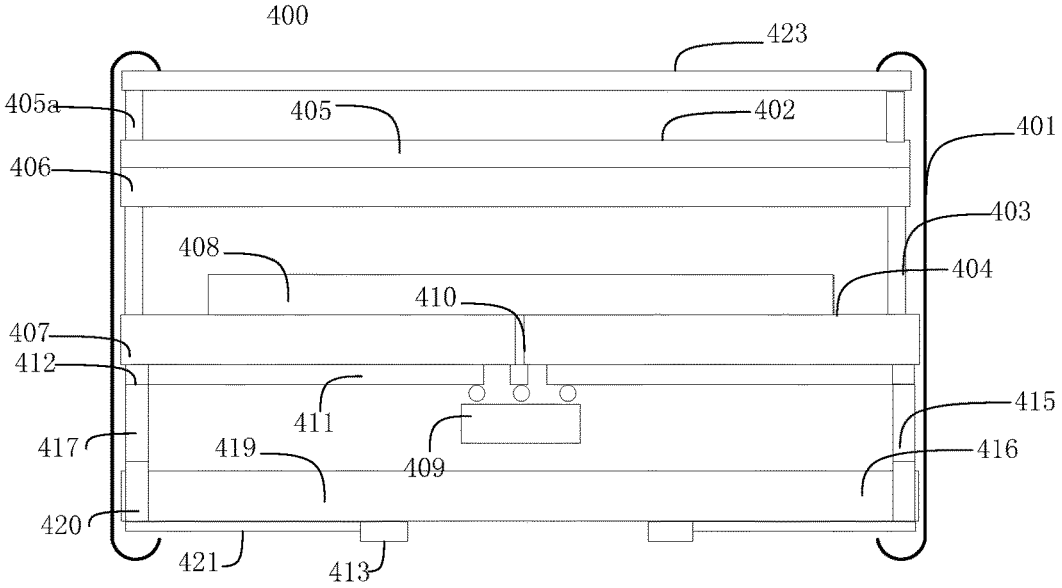
FIG. 5 is a sectional view of an example microphone of FIG. 4.

FIG. 5 is a sectional view of an example microphone according to electret condenser microphone 400 depicted in FIG. 4. As shown in FIG. 5, electret condenser microphone 400 includes anti-dust cover 423, diaphragm 402, which consists of a metallic layer 405 (with a metallic tension ring 405*a*) and an electret layer 406 attached to one surface of metallic layer 405. Alternatively, electret layer 406 can be attached to the metal layer on the substrate of the backplate.

Spacer 403 is positioned under diaphragm 402. Spacer 403 is electrical insulator, mylar with appropriate shape.

Backplate 404 is positioned under spacer 403, which can be a PWB comprising a substrate 407 and a metal layer 408 on its upside surface towards diaphragm 402. A circuit for processing the electrical signals to be generated by the microphone in this invention is placed on the other surface of backplate 404, which, among others, include a JFET 409. JFET 409 is used to transform the high impedance signal of the small capacitor formed by the electret condenser microphone to a more usable value. JFET 409 comprises a gate terminal, a drain terminal, and source terminal. The gate terminal of JFET 409 is electrically connected to metal layer 408 via a through-hole 410. Copper traces 411 electrically connect source/drain terminals of JFET 409 to connectors 412.

Bottom layer 416 can be a PWB comprising an insulating substrate 419, conductive connectors 420 embedded in insulating substrate 419, and copper traces 421 and conductive pads 413 on its down surface. Traces 421 electrically connect connectors 420 with conductive pads 413.

Connecting layer 415 provides electrical connection between connectors 412 on backplate 404 and connectors 420 on bottom layer 416. Connecting layer 415 can be annular PWB with conductive connectors 417 protruding through the body of connecting layer 415.

With this arrangement, terminals of JFET 409 and other components of the circuit on the backplate can be electrically coupled to pads on bottom layer 416.

One advantage of this invention is that it is easy to assemble the electret condenser microphone described here. The major components of the electret condenser microphone according to this invention are PWBs, and they can be manufactured by standard higher volume PWB manufacturing methods. And the microphone can be assembled with automated manufacturing equipment.

Figure 6:
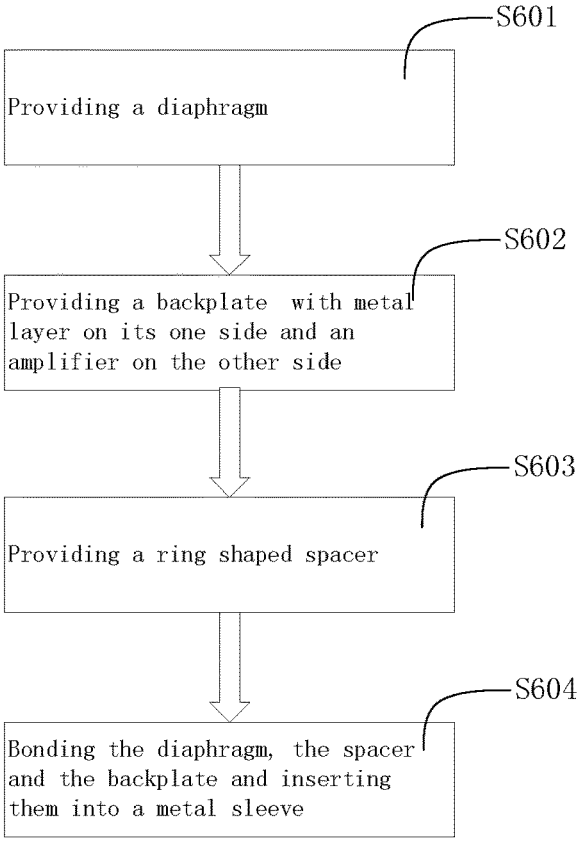
FIG. 6 illustrates a flow chart for a method for manufacturing an electret condenser microphone.

In FIG. 6, a method for manufacturing an electret condenser microphone according to one embodiment of the invention is illustrated. In step S601, a diaphragm is provided. As discussed above, the diaphragm can have a metalized layer with an electret layer. Alternatively, the electret layer can be attached to the metal layer on the substrate of the backplate.

In step S602, a backplate is provided with metal layer on its surface towards the diaphragm and an amplifier, like a JFET on the other surface. The gate terminal of JFET is connected to metal layer via a through-hole in the backplate.

In step S603, a spacer is provided. The spacer can be a mylar sheet of a ring shape.

In step S604, the diaphragm, the spacer and the backplate are bonded together and inserted into a metal sleeve.

Figure 7:
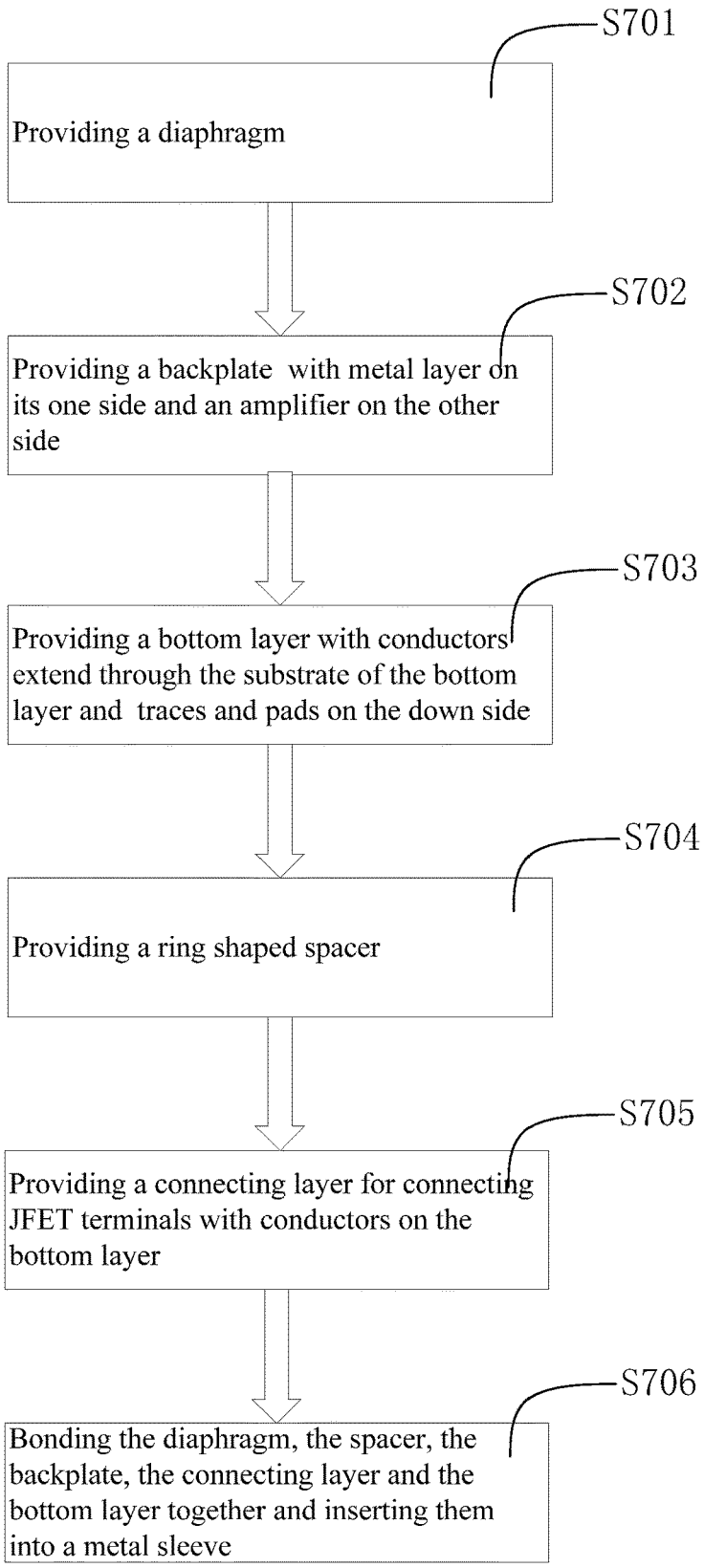
FIG. 7 illustrates a flow chart for another method for manufacturing an electret condenser microphone.

FIG. 7 illustrates a method for manufacturing an electret condenser microphone according to another embodiment. In step S701, a diaphragm is provided. The diaphragm can have a metalized layer with an electret layer. Alternatively, the electret layer can be attached to the metal layer on the substrate of the backplate.

In step S702, a backplate is provided with metal layer on its surface towards the diaphragm and an amplifier, like a JFET on the other surface. The gate terminal of JFET is connected to metal layer via a through-hole in the backplate. Other terminals of the JFET are electrically connected to the conductors in the backplate surface.

In step S703, a bottom layer is provided with conductors extend through the substrate of the bottom layer and traces and pads on its surface. The traces electrically connect the conductors and the pads.

In step S704, a spacer is provided. The spacer can be a mylar sheet of a ring shape.

In step S705, a connecting layer is provided. The connecting layer is formed of annular PWB and has connectors protruding through the body of connecting layer to connect conductors on the backplate and conductors in the bottom layer.

In step S706, the diaphragm, the backplate, the bottom layer, the spacer and the connecting layer are bonded together and inserted into a metal sleeve.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. An electret condenser microphone, comprising:
a diaphragm,
a backplate with a metal layer on a side facing the diaphragm and an amplifier on positioned on another side of the backplate, an input of the amplifier electrically connecting the metal layer,
a spacer positioned outwardly of the backplate and separating the diaphragm and the backplate; and
a metal sleeve accommodating the diaphragm, the backplate, and the spacer,
wherein a gap is formed between the spacer and the metal layer.

2. The electret condenser microphone according to claim 1, wherein the backplate is formed of a printed wire board (PWB) material.

3. The electret condenser microphone according to claim 1, wherein the spacer between the backplate and the diaphragm is formed of an annular insulating material.

4. The electret condenser microphone according to claim 3, wherein the annular insulating material is mylar plastic.

5. The electret condenser microphone according to claim 1, wherein the amplifier is a junction field effect transistor (JFET) and the input is a gate terminal of the JFET.

6. The electret condenser microphone according to claim 1 further comprising a connecting layer and a bottom layer, the connecting layer electrically connecting terminals of the amplifier to pads on a bottom layer.

7. The electret condenser microphone according to claim 6, wherein the connecting layer is formed of an annular PWB with conductive connectors protruding through a body of the connecting layer.

8. The electret condenser microphone according to claim 6, wherein the bottom layer comprises a printed wire board (PWB) substrate, conductive connectors embedded in the PWB substrate, traces on the PWB substrate, and pads on the PWB substrate.

9. The electret condenser microphone according to claim 1 further comprising an anti-dust cover within the metal sleeve at an opening of the electret condenser microphone.

10. A method of manufacturing an electret condenser microphone, comprising:
providing a diaphragm;
providing a backplate with a metal layer a surface thereof being orientated towards the diaphragm and an amplifier positioned on another surface, an input of the amplifier being electrically connected to the metal layer;
providing an insulating spacer that is positioned outwardly of the backplate;
bonding the diaphragm, the insulating spacer, and the backplate together; and
inserting the diaphragm, the insulating spacer, and the backplate into a metal sleeve,
wherein a gap is formed between the insulating spacer and the metal layer.

11. The method according to claim 10, wherein the backplate is formed of a printed wire board (PWB) material.

12. The method according to claim 10, wherein the insulating spacer between the backplate and diaphragm is formed of an annular insulating material.

13. The method according to claim 12, wherein the insulating material is mylar plastic.

14. The method according to claim 10, wherein the amplifier is a junction field effect transistor and the input is a gate terminal of the JFET.

15. A method of manufacturing an electret condenser microphone, comprising:

providing a diaphragm;

providing a backplate with a metal layer on a surface thereof being orientated towards the diaphragm and an amplifier positioned on another surface, an input of the amplifier being electrically connected to the metal layer;

providing a bottom layer with conductors that extend through a substrate of the bottom layer and traces and pads on its surface;

providing an insulating spacer that is positioned outwardly of the backplate;

forming a gap between the insulating spacer and the metal layer;

providing a connecting layer with conductive connectors protruding through a body of the connecting layer;

bonding the diaphragm, the backplate, the bottom layer, the insulating spacer and the connecting layer together; and inserting the diaphragm, the backplate, the bottom layer, the insulating spacer and the connecting layer into a metal sleeve.

16. The method according to claim 15, wherein the backplate is formed of a printed wire board (PWB) material.

17. The method according to claim 15, wherein the insulating spacer is formed of annular insulating material.

18. The method according to claim 17, wherein the annular insulating material is mylar plastic.

19. The method according to claim 15, wherein the amplifier is a junction field effect transistor (JFET) and the input is a gate terminal of the JFET.

20. The method according to claim 15, wherein the bottom layer comprises a printed wire board (PWB) substrate.

21. The electret condenser microphone according to claim 1, wherein the spacer and the metal layer are positioned on an insulating substrate and the gap separates the spacer from the metal layer on the insulating substrate.

* * * * *